US005334264A

United States Patent [19]

Meletis

[11] Patent Number: 5,334,264

[45] Date of Patent: Aug. 2, 1994

[54] TITANIUM PLASMA NITRIDING INTENSIFIED BY THERMIONIC EMISSION SOURCE

[75] Inventor: Efstathios I. Meletis, Baton Rouge, La.

[73] Assignee: Board of Supervisors of Louisiana State University and Agricultural and Mechanical College, Baton Rouge, La.

[21] Appl. No.: 906,929

[22] Filed: Jun. 30, 1992

[51] Int. Cl.[5] ..... C22C 14/00; C22C 27/00

[52] U.S. Cl. ..... 148/222; 148/421; 427/570; 437/16; 437/18

[58] Field of Search ..... 148/222, 421; 427/570; 437/16, 18

[56] References Cited

U.S. PATENT DOCUMENTS

| | | | |
|---|---|---|---|
| 3,677,832 | 7/1972 | Van Thyne et al. | 148/31.5 |
| 4,465,524 | 8/1984 | Dearnaley et al. | 148/421 |
| 4,664,769 | 5/1987 | Cuomo et al. | 427/570 |
| 4,675,206 | 6/1987 | Ikegaya et al. | 427/570 |
| 4,948,458 | 8/1990 | Ogle | 427/570 |
| 5,156,703 | 10/1992 | Oechsner | 156/643 |
| 5,169,597 | 12/1992 | Davidson et al. | 420/418 |

FOREIGN PATENT DOCUMENTS 2190100 11/1987 United Kingdom .

OTHER PUBLICATIONS

Rie, K. T., et al. Thermochemical Surface Treatment of Titanium Alloy Ti-6Al-4V by Low Energy Nitrogen Ion Bombardment *Materials Science and Engineering,* 69 (1985) pp. 473–481.

Meletis, E. I. et al. Formation of aluminum nitride by intensified plasma ion nitriding *J. Vac. Sci. Technol.* A 9 (4), (1991) pp. 2279–2284.

Metin, E. et al., in Spalvins (Ed.), Characterization of Ion Nitrided Structures of Ti and Ti 6242 Alloy, American Society for Metals, OH, pp. 61–75.

VanderWert, T. L. Surface Modification Technologies III Edited by T. S. Sucdarshan et al., Surface Modification by Magnetic Treatment, The Minerals, Metals & Materials Society, 1990 pp. 393–402.

Metin, R. S. Plasma Surface Treatment of Titanium and Titanium Alloys Light Metal Age (1989) pp. 26–35.

Grill, A. et al. Layer Structure and Mechanical Properties of Low Pressure R.F. Plasma Nitrided Ti-6Al-4V Alloy *Surface and Coatings Technology,* 43/44 (1990) pp. 745–755.

Raveh, A. et al. Microstructure and Composition of Plasma-Nitrided Ti-6Al-4V Layers *Surface and Coatings Technology* 38 (1989) pp. 339–351.

Raveh, A. et al. R.F. Plasma Nitriding of Ti-6Al-4V Alloy *Thin Solid Films* 186 (1990) pp. 241–256.

Raveh, A. et al. Microstructure of Low-Temperature RF Plasma-Nitrided Titanium Alloy *Israel Journal Technology* 24 (1988) pp. 489–497.

Metin, E. et al. Kinetics of Layer Growth and Multiphase Diffusion in Ion-Nitrided Titanium *Metallurgical Transactions A 20A* (1989) pp. 1819–1932.

*Primary Examiner*—Uprendra Roy

*Attorney, Agent, or Firm*—Scully, Scott, Murphy & Presser

[57] ABSTRACT

The present invention relates to ion nitriding of pure titanium or titanium-containing alloys at low pressure by intensifying the glow discharge.

Plasma intensification was produced by thermionic emission in conjunction with a triode glow discharge system. Effective ion nitriding can be achieved by employing the present invention at relatively low temperatures (480° C.) and with significantly enhanced compound layer growth kinetics compared to the conventional nitriding techniques. Processed Ti and Ti-6Al-4V developed a surface layer of TiN followed by a $Ti_2N$ layer and an interstitial nitrogen diffusion zone. Processed specimens showed a three fold increase in surface hardness. Surface roughness was found to be a function of the degree of plasma intensification. Processing of Ti-6Al-4V resulted in a higher wear, corrosion and wear-corrosion resistance. The present invention indicates that ion nitriding with intensified glow discharge has a great potential as a surface modification method for Ti and Ti alloys. Materials nitriding by the present invention having the properties defined above are suitable for use as orthopaedic implant devices as well as other applications of titanium and titanium alloys requiring resistance to wear and corrosion.

20 Claims, 15 Drawing Sheets

TITANIUM PLASMA NITRIDING INTENSIFIED BY THERMIONIC EMISSION SOURCE

FIELD OF THE INVENTION

The present invention relates to a process for implanting nitrogen in the surface of titanium or titanium-containing alloys by employing an improved plasma nitriding technique. More specifically, the present invention relates to the surface hardening of titanium or titanium alloys at relatively low temperatures by employing an intensified plasma-assisted ion nitriding process. The resultant titanium or titanium-containing alloys which are nitrided by this process have improved wear and corrosion characteristics which makes the product suitable for use as orthopaedic implant devices and other applications or devices requiring resistance to wear and corrosion.

BACKGROUND OF THE PRIOR ART

Titanium and titanium-containing alloys are known in the art as possessing excellent strength to weight ratio, fracture toughness, corrosion resistance and biocompatibility; however, these materials are also characterized as having unsatisfactory wear performance. Thus, continued research in this area is oriented to improve the wear performance of titanium or titanium-containing alloys without adversely effecting the other physical properties of these materials.

It is well known in the art that titanium and titanium-containing alloys can be nitrided to form a hard surface layered material which has improved wear characteristics and fatigue crack initiation resistance.

U.S. Pat. No. 3,677,832 to Van Thyne et al. relates to a group of ternary or higher alloyed metals which consist essentially of Ti, at least one of Va, Be and Ta, and at least one of Mo and W. These alloys are then nitrided to cause surface hardening without any substantial chipping or brittleness. The nitrided alloys demonstrate improved wear and abrasion resistance.

U.S. Pat. No. 4,465,524 to Dearnaley et al. provides a workpiece of titanium or a titanium-containing alloy having a surface treated to improve its wear resistance. The surface of the titanium or its alloy are first coated with a layer of a metal such as Al, Co, Fe, Sn, Ni, Pt, Zn or Zr and then subjected to bombardment with light ion species.

The process of nitriding titanium or its alloys has led to increased applications for these materials. Such applications include tribological orthopaedic devices, gears, valves, pumps and the likes thereof.

In recent years, there have been several successful methods for producing a TiN surface layer on a titanium or a titanium-containing alloy in an attempt to improve the wear performance of these materials. These methods include reactive sputtering, physical vapor deposition, chemical vapor deposition, ion implantation and pulse implantation.

The first three methods are deposition processes which produce a discrete TiN film on the substrate whereas ion implantation is a physical process. Pulse ion implantation provides a three dimensional coverage but the method is depth limited and produces a fine distribution of TiN particles rather than a continuous layer. In addition to these undesirable results, the method requires high vacuum (in the order of $10^{-6}$ Torr) and a high energy accelerator (50–100 KeV).

Conventional ion nitriding is another method of producing TiN at the surface of titanium and titanium-containing alloys. Conventional ion nitriding is usually conducted at relatively high pressures of about 1 to 10 Torr and high temperatures of about 700°–1100° C. with the applied DC voltage ranging from 300–800V. This method is characterized by a low ionization efficiency and low particle energy. Ion nitriding of titanium or titanium-containing alloy has been found to produce a thin surface layer which is composed of cubic δ-TIN phase followed by a $\epsilon$-$Ti_2N$ layer and an interstial nitrogen diffusion zone in the adjacent $\alpha$-Ti matrix: for example see A. Raveh, et al., Surface and Coatings Technology, Vol. 43/44 (1990), pgs. 745–755; A. Raveh, et al., Surface and Coatings Technology, Vol. 38 (1989), pgs. 339–351; A. Raveh, et al., Thin Solid Israel J. of Tech., Vol. 24 (1988), pgs 489–497; and E. S. Metin and O. T. Inal. Light Metal Age, October 1989, pgs. 26–30.

The method of ion nitriding typically employs a glow discharge source to produce an energetic flux of nitrogen ions and neutral species that heats the work piece, sputter cleans the surface, supplies active nitrogen and provides the energy for compound formation.

British Patent No. 2,190,100 relates to a forge, cast or sintered titanium alloy and machine parts made therefrom the surface layers of which are treated at above 700° C. in glow-discharge plasma. The resultant materials treated by such a process are characterized as having improved abrasion resistance. The surface layers are derived from a treatment gas containing small quantities (partial pressure 0.1 to 4 mbar) of nitrogen and, if necessary, carbon and/or oxygen.

Previous studies indicate that the growth of the nitride layer is controlled by a volume-diffusion process, thus the surface depth achieved by ion nitriding is proportional to the square root of time. Despite its potential success, conventional ion nitriding has the following disadvantages: (1) the method requires high temperature which makes processing of temperature sensitive materials difficult and (2) nitriding some materials is not feasible. Therefore, continued improvement in the area of ion nitriding is continually being sought in order to provide articles with enhanced wear and corrosion resistance. Such articles possessing these characteristics makes them suitable for use as orthopaedic implant devices and other applications or devices requiring resistance to wear and corrosion.

SUMMARY OF THE INVENTION

According to the present invention there is provided an improved process for implanting nitrogen in the surface of titanium or a titanium-containing alloy which is effective in enhancing the wear and corrosion resistance properties of the resultant article. More specifically, the invention relates to an intensified plasma-assisted ion nitriding process used for surface hardening of titanium, alloys of titanium, and materials containing titanium. Such materials nitrided by the present invention exhibit excellent wear/corrosion characteristics, thus these materials are suitable for use as orthopaedic implant devices and other applications or devices requiring resistance to wear and corrosion.

By intensifying the glow discharge during ion nitriding significant improvements in the ion nitriding process and in the microstructure of the produced layers can be achieved. Intensification of the glow discharge is accomplished by combining a thermionic source with a triode glow discharge source which may comprise a positively charged electrode, an RF source, a magnetic field or other sources sometimes utilized in conventional ion nitriding systems. By intensification, we denote an increasing number of electrons or ions having a higher energetic flux density. This combination is effective in providing extra electrons which can collide with the ionized neutral gas atoms and molecules. Thus, the glow discharge of the present invention can be sustained at much lower pressures compared with conventional ion nitriding and is further characterized as having a high degree of ionization, i.e. electron or ion flux density and throwing power, i.e. the energy of the electron or ions applied to the surface.

More particular in accordance with the present invention, a process is provided wherein ion nitriding of a material can be accomplished at significantly lower bulk temperatures and at much shorter processing time due to enhanced nitrogen diffusion kinetics than conventional ion nitriding.

DETAILED DESCRIPTION OF THE INVENTION

As indicated hereinbefore, the present invention relates to an intensified plasma assisted ion nitriding process for providing a surface hardening of materials wherein a thermionic emission source is combined with a triode glow discharge system.

The ion nitriding system utilized in this invention is shown in FIG. 1. The detailed description of this triode ion nitriding system has been previously disclosed by E. I. Meletis and S. Yan, J. Vac. Sci. Techno., Vol. 9A (1991) pg. 2279.

The specimens used in the instant invention are commercially pure titanium or titanium-continuing alloys. In an embodiment of the present invention, the titanium material has a purity of about 95.5 to about 99.99%. More preferably, the purity of the titanium species is from 97.99 to about 99.99%. Basically all titanium-containing alloys are suitable, including $\alpha$, $\beta$ and $\alpha/\beta$ compositions Of these titanium-containing alloys, Ti-6Al-4V is particularly preferred.

The commercially pure titanium or titanium containing alloys of the present invention can be in the form of conventional mill products such as ingots, billets, sheets, rods, plates, and the likes thereof. The alloys may also be in the form of casts or forged or other fabricated articles such as orthopaedic implant devices. In another embodiment of the invention, the titanium or titanium containing alloys are cut into rods or discs prior to subject them to the nitriding process. The diameter of the rods used in the present invention are from about 1.0 to about 10 cm. More preferably, the rods have a diameter of about 1 to about 5 cm. It should also be recognized that rods having larger diameters may also be also employed by the present process. The only limitation on the shape and size of the specimen is the area of the working chamber of the plasma-nitriding device. Disc specimens having a diameter of about 0 to about 100 mm and a thickness of about 0 to about 50 mm can be employed by the present process. As indicated previously herein, the article may have any dimension including a complex geometry provided that the article can be placed within the working chamber of the plasma-nitriding device.

In an embodiment of the present invention, the specimen is then placed into the plasma nitriding device for processing. Any mixtures of inert gases and nitrogen can be utilized in the nitriding process of the present invention, e.g. helium, argon, and mixtures thereof. In a preferred embodiment, the plasma gas utilized in the present invention is an argon-nitrogen mixture. The gas or mixtures utilized in the present process have a purity of about 95.999 to about 100%. More preferably, the purity of the gas or gas mixtures is from about 97.999 to about 99.999%. When a gas mixture such as $Ar:N_2$ is used in the present process, the gas ratio of $Ar:N_2$ is from about 1:1 to about 1:7. More preferably, the ratio of Ar:N is 1:3.

Standard procedures as described by Meletis, et al., Surface Modification Technologies IV, The Minerals, Metals & Materials, Society, (1990) pg 45, were followed for processing the titanium or titanium containing alloys. The plasma nitriding device was initially evacuated down to a pressure in the range of about $5\times10^{-6}$ Torr to about $1.5\times10^{-5}$ Torr to remove the oxygen atmosphere initial present in the plasma-nitriding apparatus. After maintaining this pressure for a period of time, essentially pure Ar (99.999%) at a pressure of about $5\times10^{-2}$ Torr to about $1\times10^{-1}$ Torr was backfilled into the plasma-nitriding device. These steps of evacuation and filling with pure Ar were repeated up to about two times. Thereafter the specimen was cleaned by conventional sputtering techniques known in the art. In another embodiment of the invention, sputtering was performed at a basis voltage of about 2000V in an Ar atmosphere of about 50 mTorr for approximately 25 minutes. After this period of time, the system is pumped down to a pressure of about $5\times10^{-6}$ Torr to about $1.5\times10^{-5}$ Torr, and the argon-nitrogen gas mixture was admitted to the chamber through valves, in designated proportions as herein above defined.

The pressure was then dynamically controlled to a pressure in the range of about 5 to about 250 mTorr. More preferably, a controlled pressure from about 45 to about 200 mTorr was achieved and maintained throughout the duration of the plasma nitriding process. The nitriding of the specimen is then initiated by applying a bias voltage of about 200V to about 5KeV to the specimen. More preferably, the bias voltage utilized in the present invention was from about 1 to about 3KeV. The bias voltage can be supplied by any DC high voltage source known in the art.

After initiating the bias voltage, the thermionic electron emission source was activated. Suitable thermionic electron emission sources used in the present invention include any high current low voltage sources. Of these thermionic electron emission sources, a tungsten filament is the most preferred. The current applied to the tungsten filament is adjusted such that a cathode current density of about 0.5 to about 4 $mA/cm^2$ is produced. In a preferred embodiment, the current applied to the tungsten filament is adjusted so that the cathode current density is in the order of 3.13 $mA/cm^2$.

The resultant current density range defined above produces a cathode substrate temperature of about 300° to about 600° C. In a preferred embodiment of the invention, the current density of 3.13 $mA/cm^2$ produces a cathode substrate temperature of about 480° C. This temperature is considerably lower than the temperatures normally associated with conventional ion nitriding systems therefore the present process is effective in nitriding temperature sensitive materials which are often difficult to process by conventional ion nitriding.

The positive plate utilized by the present invention may be a positively charged electrode, an RF source, a magnetic field or the like. In one embodiment of the present invention, the plate is a positively charged electrode. The voltage applied to the positive electrode is supplied by any DC voltage supply which can effectively deliver a voltage of about 0 to about 150V. Suitable DC voltage supply sources include any commerical low voltage DC power supply. The processing time for implanting nitrogen in the surface of titanium or a titanium-containing alloy is from about 1 hr. to about 20 hrs. The time of implanting nitrogen in the surface of the specimen by the present process is much less than the processing times normally employed in conventional ion nitriding.

By utilizing the above process, nitriding of titanium or a titanium-containing alloy can be achieved at relatively low temperatures and with significantly enhanced compound layer growth kinetics compared to conventional nitriding techniques. In another preferred embodiment of the invention, the intensified ion nitriding process results in a surface layer of nitrogen having a depth of about 20 to about 90 μm. More preferably, the process results in a surface layer of nitrogen having a depth of 50 μm. It should be recognized that the depth of the surface layer of nitrogen is dependent on the process time. Furthermore, the intensified-plasma-assisted ion nitriding process of the present invention results in enhanced ionization due to the increasing number of electrons in the plasma gas caused by combining the thermionic source in the preferred embodiment with the positively charged plate. This combination along with a lower pressure results in a higher ionization which greatly improves the throwing power of the plasma resulting in a number of beneficial effects to the thus surface nitrided product. For example, the beneficial effects of the present invention include surface treatment at lower temperatures, enhanced compound layer growth rates, and nitriding materials which are often difficult or impossible to nitride.

The surface treated titanium and titanium-containing alloys are then subjected to a number of different techniques in order to characterize the nitrided surface of these materials. Characterization techniques utilized by the present process are those techniques commonly employed in the art such as: microhardness measurements, optical microscopy, Scanning Electron Microscopy (SEM), X-Ray Diffraction (XRD), X-Ray Photoelectron Spectroscopy (XPS) and Auger Electron Spectroscopy (AES). Surface microhardness measurements were conducted in order to evaluate the effect of the processing parameters and characterize the surface compounds. Microhardness testing of metallographic cross section was performed to measure the thickness of the compound layers and to obtain the nitrogen diffusion profiles. Surface appearance and cross sections were also observed by SEM. Compounds formed during the nitriding process are identified by XRD. The surface composition and chemical state of the compounds formed during processing were determined by AES and XPS techniques.

Besides hardness, the processed nitrided surfaces were tested for the following properties: surface roughness, wear, corrosion and wear-corrosion (i.e. combined action of wear and corrosion).

Surface roughness measurements were made on both processed and unprocessed samples using a Tancor Instruments profilometer. Tests were also performed on specimens processed under a combination of glow discharge conditions in order to evaluate the effect of sputtering during processing on surface roughness.

Wear performance was evaluated by using a standard pin-on-disc apparatus known in the art. The wear action was provided by a ball 1 cm in diameter loaded with 5 N. Two ball materials were used: $Al_2O_3$ and 440c martensitic stainless steel. The disc specimens were rotated at a velocity of 50 rpm, and the tests were conducted for a total of 90 min. Wear performance was assessed by profilometric measurements on wear track and calculating volume loss of the disc ($W_d$) and ball material ($W_b$).

General corrosion behavior of processed specimens was evaluated by carrying out deaerated and aerated anodic polarization tests. Disc specimens were mounted in epoxy, leaving only the processed area exposed to the environment. These test were conducted in 3.5 wt % NaCl solution (pH=6.9) at 25° C. All corrosion potentials were measured with respect to a saturated calomel electrode (SCE). The scan rate used was 0.2 mV/s. Similar tests were conducted on unprocessed specimens to be used as standards. An EG&G computer controlled Corrosion Measurement System (Model 273) was utilized in the experimental analysis.

Wear-corrosion performance of processed and unprocessed specimens was studied by utilizing a dynamic wear-corrosion apparatus described by Meletis, J. Mater. Eng., 11 (1989) pg 169. Ring samples of the nitrided materials were made having a diameter of 37.5 mm and a thickness of 5 mm and then polished with 1 μm alumina. The samples were coated with an insulating paint, leaving only the test area (a section of the cylindrical disc area) exposed to the solution. Wear-corrosion testing was conducted in aerated 3.5 wt % NaCl solution (pH=6.9). During testing, the disc specimen is oscillated (±30° ) in the electrolyte while a loaded pin is providing the sliding-wear action. In the present process, a cylindrical ceramic pin of 3.2 mm radius was used and was loaded with 1200 g. This particular configuration produces a line theoretical contact and a 110 MPa stress on the specimen.

Two types of corrosion test under wear were performed, potential-time measurements and potentiostatic corrosion current-time tests. In the potential-time tests, the corrosion potential was monitored until it was stabilized, then the wear process was activated for 90 s, stopped (to allow repassivation), and reactivated, while the potential was measured continuously. This cycle was repeated three times in each experiment. In the potentiostatic corrosion current-time tests, a potential of −725 mV was first applied and then the wear action was initiated and the current was recorded continuously. This test was also conducted in 90 s cycles.

DESCRIPTION OF THE DRAWINGS

FIG. 6(*b*) represents the microhardness profile of FIG. 6(*a*).

EXAMPLE I

Optimization of the Ar:$N_2$ Gas Ratio

The following experiments were conducted to optimize the Ar:$N_2$ gas ratio to be employed during the nitriding process. A pure titanium rod having a diameter of 6.8 cm was annealed at a temperature of 700° C. for 2 hrs. in an Ar atmosphere. Thereafter, the specimens were cooled in Ar to ambient and then metallographically polished with 0.05 μm alumina. The specimen to be nitrided was then cleaned in methanol followed by air drying.

Figure 1:
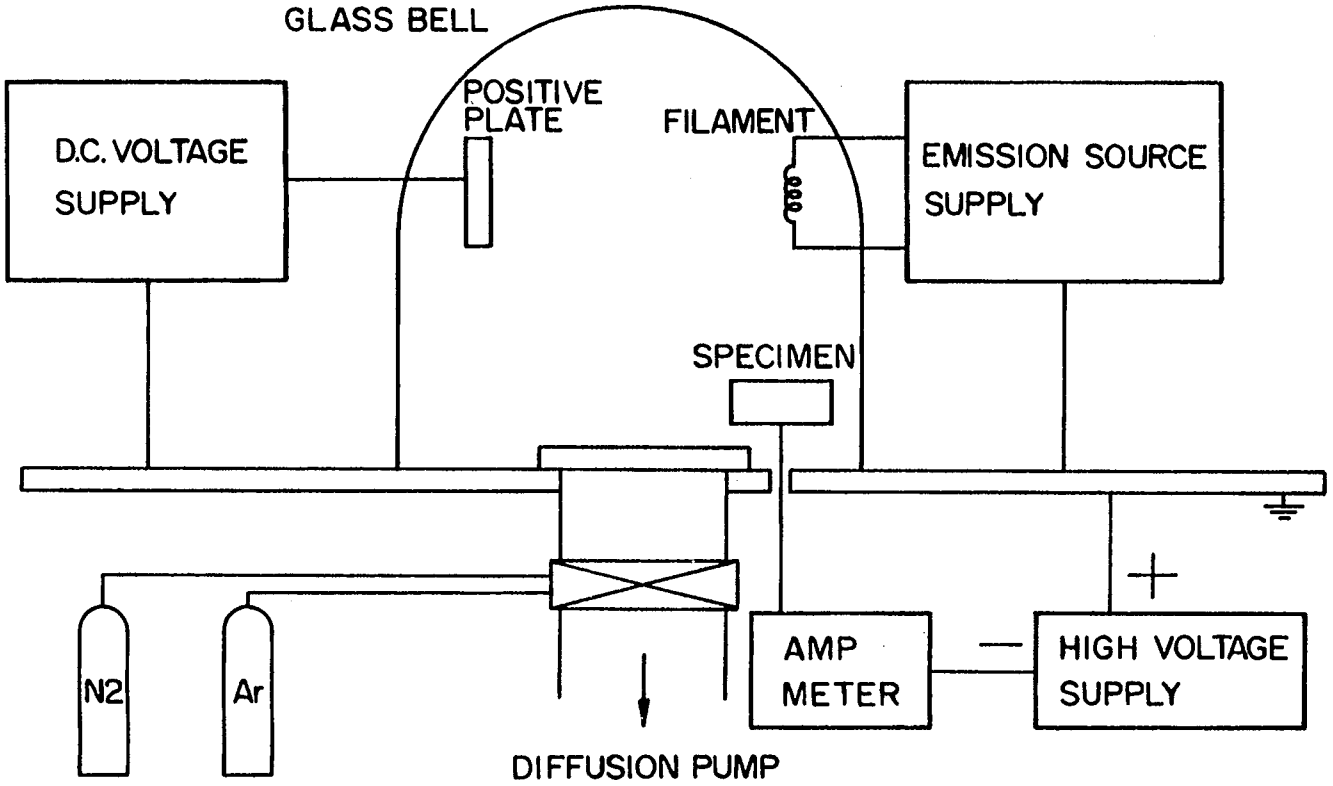
FIG. 1 illustrates the plasma-nitriding apparatus used in the present invention.

The dried specimen was then placed inside the plasma nitriding system shown in FIG. 1. The pressure of the system was maintained at 50 mTorr for 8.5 hrs while the gas ratio of At:$N_2$ was varied to determine the optimal level to use during processing.

Five different gas ratios were used (At:$N_2$32 1:5, 1:3, 1:2, 1:1 and pure $N_2$) while the bias voltage of the system was maintained at 2000v and the cathode current density was 3.13 mA/cm$^2$. The gases used were high purity gases containing less than 0.001% impurities.

Figure 2:
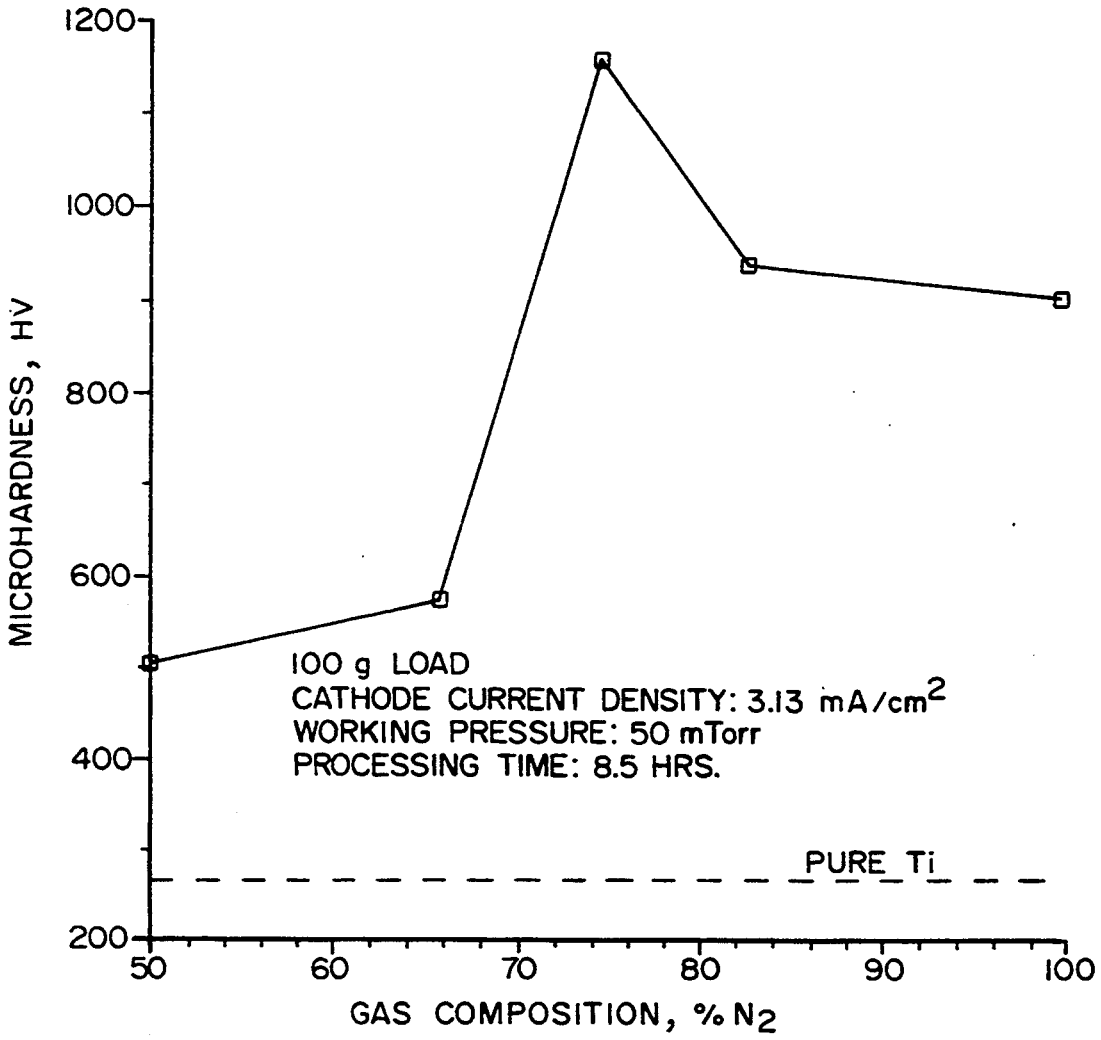
FIG. 2 represents a graph of the surface microhardness as a function of gas composition for 100 g loads of pure titanium specimens. The specimens were processed for 8.5 hrs at a working pressure of 50 mTorr and a cathode current density of 3.13 mA/cm$^2$.

The effect of the Ar:$N_2$ gas ratio on the nitriding process of pure titanium is shown in FIG. 2.

Assuming that, within the limited surface region, hardness is a function of the thickness of the formed compound layer, this data illustrated by FIG. 2 indicates that the most effective nitriding of the pure Ti specimen could be achieved at an Ar to $N_2$ ratio of 1:3. To a certain extent, addition of Ar into the plasma was found to be beneficial, which is consistent with previous results on glow discharge processing of 304 stainless steel. Without wishing to be bound by any mechanism, this suggests that there is a greater probability of ionization of Ar compared to nitrogen. Thus, in an Ar-$N_2$ discharge there appears to be a higher relative concentration of excited and ionized nitrogen compared to a pure $N_2$ discharge. Increasing the Ar content further, though, while keeping the pressure constant, reduces the nitrogen flux in the plasma resulting in a shallower compound layer. Therefore, the present results indicate that there is a compromise between glow discharge intensification and nitrogen concentration.

EXAMPLE II

Optimization of Gas Pressure

This example was conducted to determine the optimum gas pressure to be utilized during the plasma nitriding process. Pure titanium specimens annealed and cleaned in accordance with Example I were utilized in this experiment. Also, the optimum Ar to $N_2$ gas ratio as determined in Example I was employed in this example (i.e. 1:3). The experiments were performed for 4 hrs. at the Ar:$N_2$ gas ratio of 1:3 while the pressure of the system was varied from 45 to 200 mTorr. The current density and bias voltage were kept constant at the same values as indicated in Example I. The current density of 3.13 mA/cm$^2$ produced a cathode substrate of temperature of 480° C.

Figure 3:
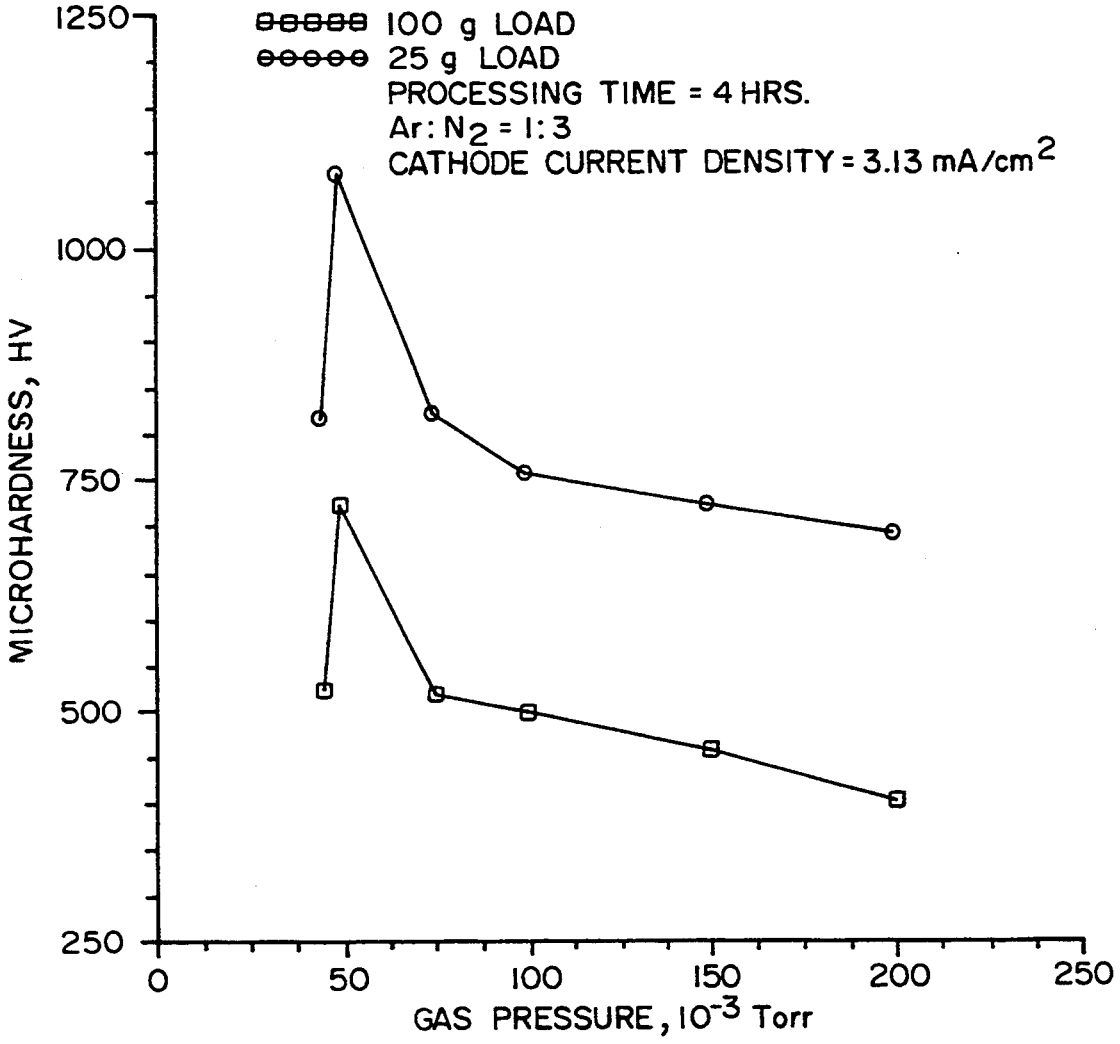
FIG. 3 represents a graph of the surface microhardness as a function of working pressure for 100 and 25 g loads of pure titanium. The specimens were processed for 4 hrs in an Ar:$N_2$ gas ratio of 1:3 at a cathode current density of 3.13 mA/cm$^2$.

The effect of working pressure on the ion nitriding process is shown in FIG. 3. Maximum hardness was obtained for a 50 mTorr pressure. Pressure dependence on the cathode current density, ionization efficiency and flux energy has been well documented for example see Matthews, et al., Thin solid Films, Vol. 80 (1981), pg 41. A decrease in pressure, while keeping the other processing parameters unchanged, results in an increase in the glow discharge intensification but also in a decrease in the nitrogen flux. Thus, both FIGS. 2 and 3 indicate that there is an optimum combination between glow discharge intensification and nitrogen concentration.

EXAMPLE III

Metallurgical Analysis of Nitrided Materials

Figure 4:
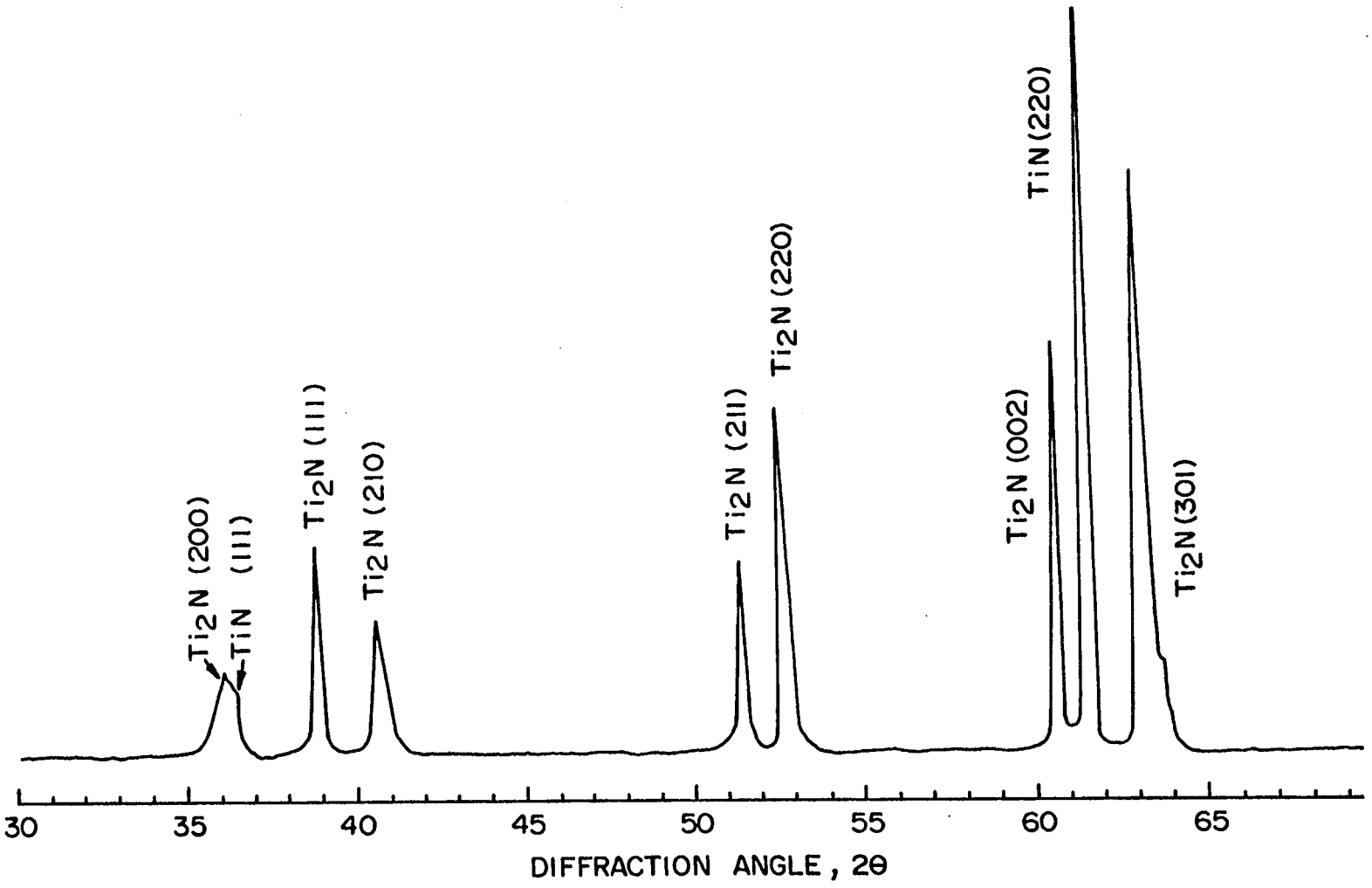
FIG. 4 represents the typical XRD pattern from processed pure Ti (8.5 h) showing only the TiN and $Ti_2N$ diffraction peaks.

Specimens from the previous examples which showed a significant increase in surface hardness were characterized by XRD analysis. All the above specimens showed the presence of δ-TiN and ε-$Ti_2N$ phases in their compound layers (FIG. 4). XRD patterns were also obtained from pure Ti specimens processed for various periods of time under the optimum conditions These patterns revealed that the δ phase developed a strong (220) orientation whereas the ε phase developed strong (301), (002) peaks and weaker (220), (211), (210), (200) and (111) peaks. Preferred crystal orientation of the nitrides is expected to have a significant effect on the properties of the modified material. For example it has been shown previously that a (111) texture of the TiN has an adverse effect on its wear resistance. The present results indicate that intensification of the glow discharge produces more desirable nitride orientations and a beneficial effect on the properties is anticipated. XRD patterns from processed Ti-6Al-4V specimens also showed a (220) preferred TiN orientation and strong (301) and (002) diffraction peaks for the $Ti_2N$ layer.

Figure 5:
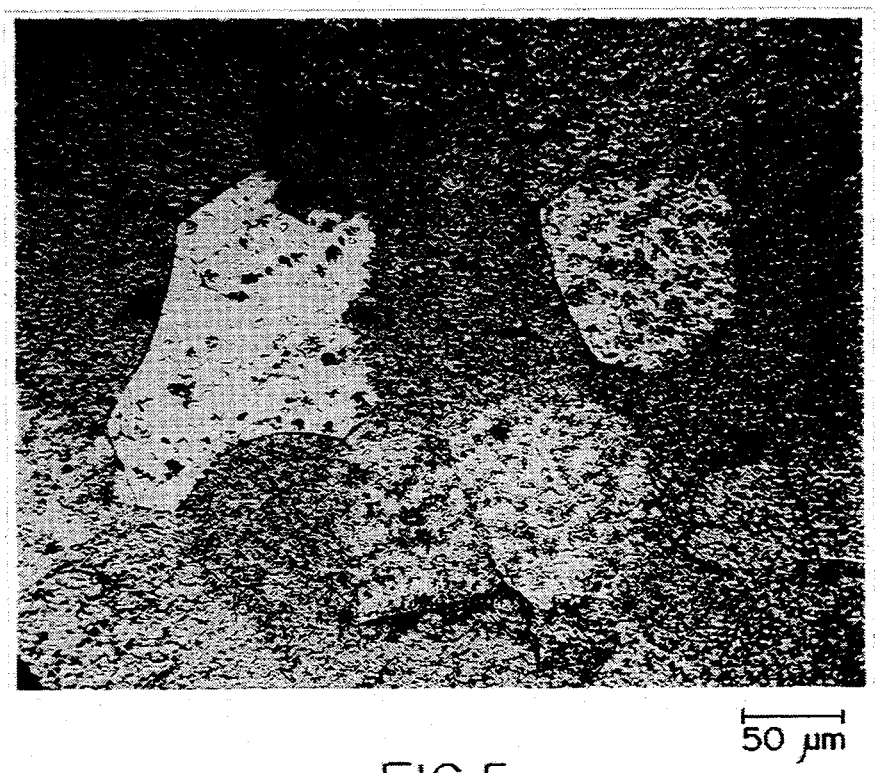
FIG. 5 represents an optical micrograph showing typical surface morphology of a processed pure Ti specimen (8.5 h).

SEM and optical microscopy of specimen surfaces after processing revealed the presence of a fine structure (TIN) along with signs of ion etching (FIG. 5) due to high energy particle bombardment. Microhardness measurements from the surface of processed pure Ti and Ti-6Al-4V specimens showed maximum hardness values of around HV 1500 (25 g load) which is at least a three fold increase over the original microhardness of the unprocessed specimens. It should be noted that nitrogen ion implantation of commercially pure Ti and $\alpha/\beta$ Ti-6Al-4V alloy can increase the surface hardness by a factor of about two. This appears to be due to the fact that the thickness of the implanted layer at the surface is limited, and nitrogen ion implantation results in a non-uniform nitrogen concentration (gaussian profile) and a post-implantation treatment may be required for a precipitation of TiN particles.

Figure 6A:
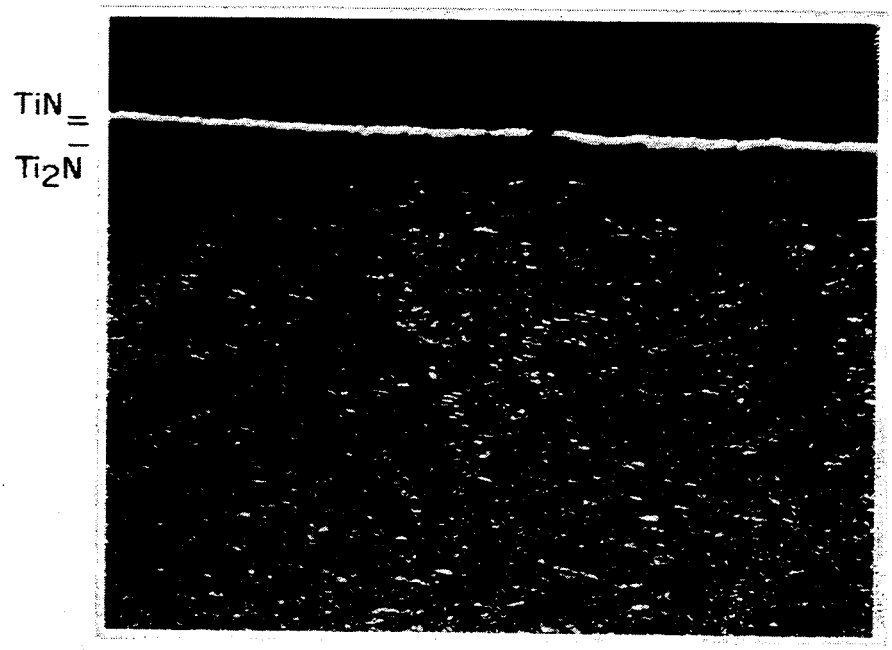
FIG. 6(*a*) represents an optical micrograph of the cross section of a processed pure Ti specimen (8.5 h).
Figure 6B:
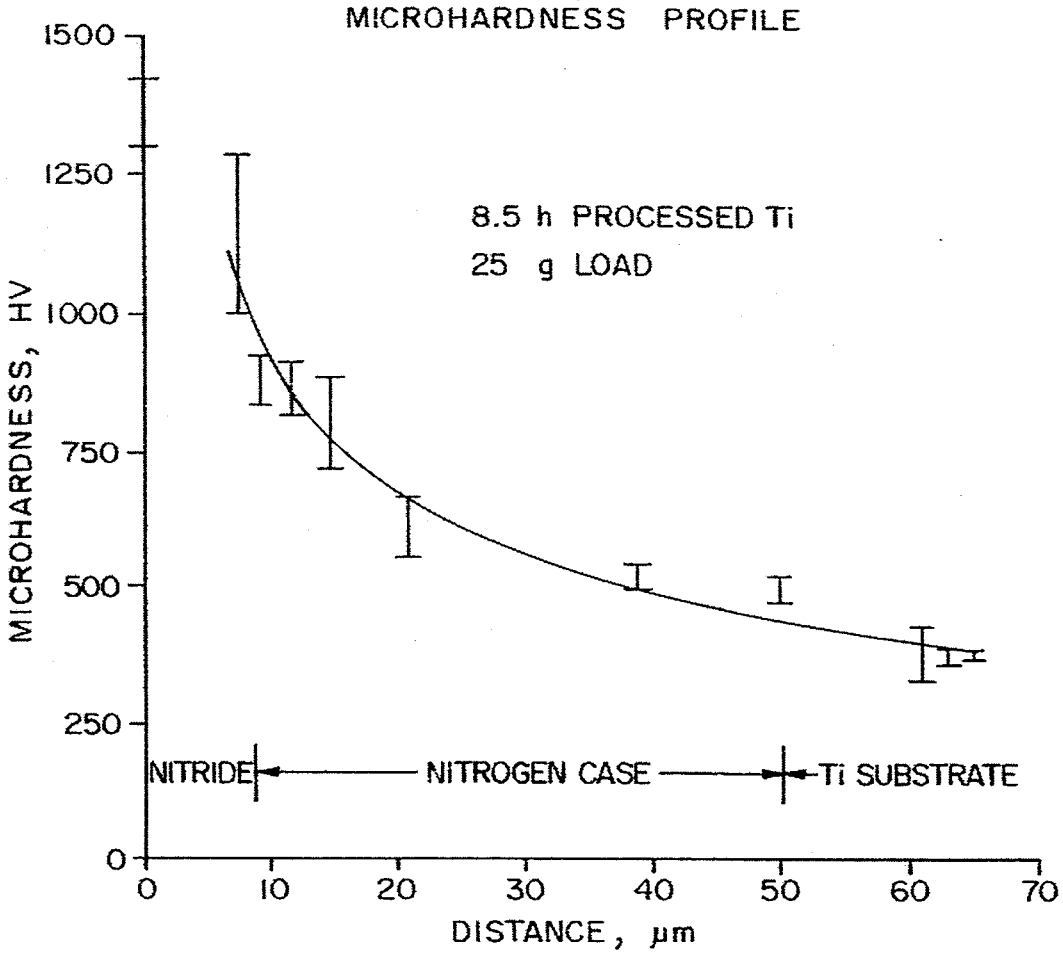
Figure 7:
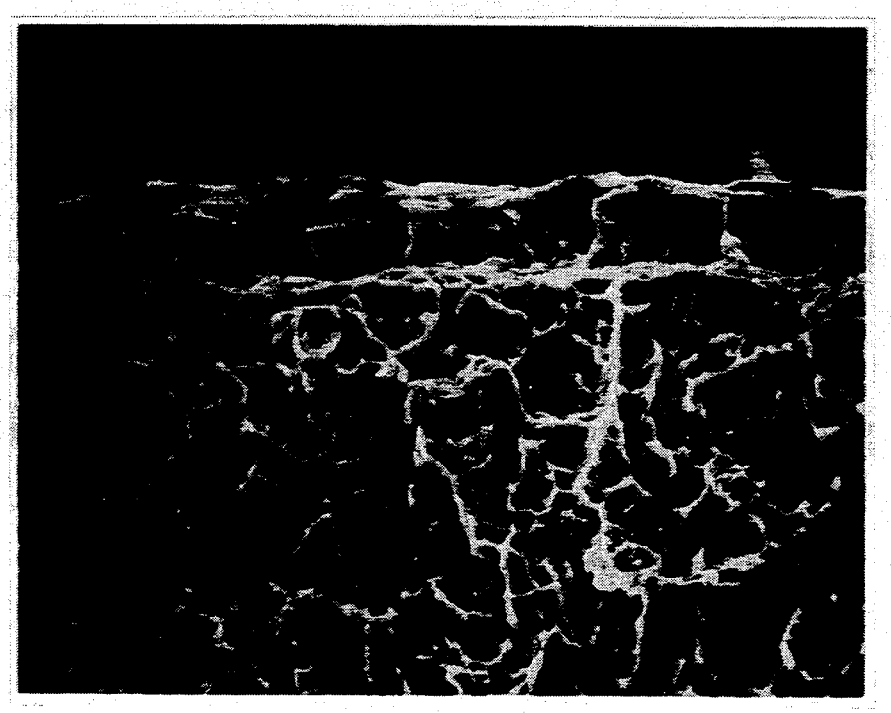
FIG. 7 represents a SEM micrograph showing the compound layer (CL) morphology in a fractured cross section of a processed Ti-6Al-4V specimen (16 h).

Microscopic examination and microhardness analysis on metallographic cross sections of processed specimens indicated the formation of two nitride layers (TiN and $Ti_2N$) followed by an interstitial nitrogen diffusion zone. A typical cross section of a pure Ti specimen processed for 8.5 h and its microhardness profile are shown in FIGS. 6(*a*) and 6(*b*). The nitrogen penetration depth estimated from FIG. 6(*b*) is nearly 50 $\mu$m. Similarly, layers of TiN and $Ti_2N$ at the surface followed by a solution of nitrogen in $\alpha$-Ti have been observed previously during ion nitriding at higher temperatures. FIG. 7 shows the layer morphology in a fractured cross section of a processed Ti-6Al-4V specimen. The nitride layer shows excellent adherence to the matrix with no evidence of cracking in the layer-matrix interface. Also, significant microductility is present in the nitrogen diffusion zone.

Figure 8:
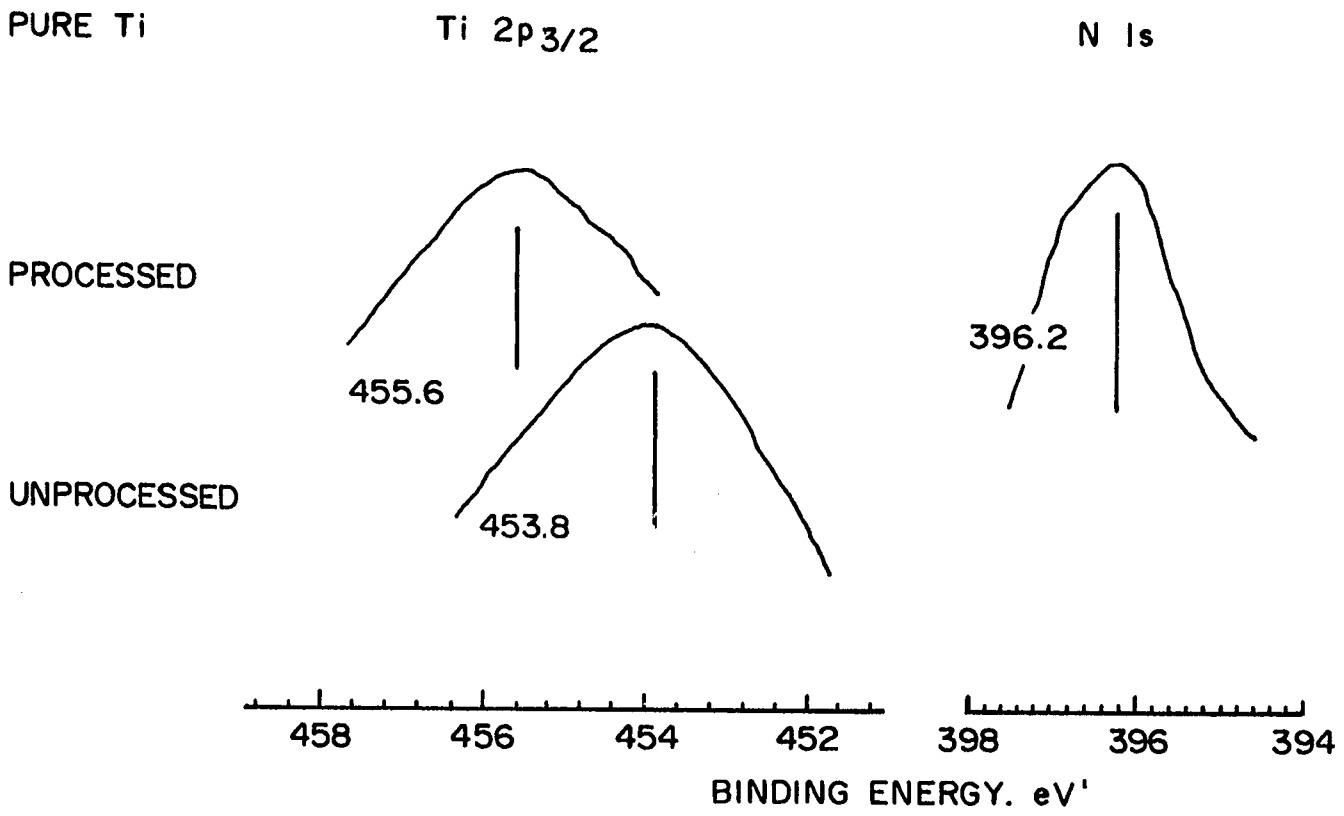
FIG. 8 represents a XPS high resolution spectra of processed and unprocessed pure Ti specimens. The binding energies of 453.8 eV and 455.6 eV correspond to Ti $2P_{3/2}$ electron in pure Ti and TiN, respectively.

AES surface analysis of processed pure Ti specimens showed that the main elements present were Ti and N. Small peaks for C and O (contamination) were also recorded, but they were significantly reduced after light sputtering. High resolution XPS spectra of processed Ti specimen surfaces indicated Ti $2p_{3/2}$ and N Is binding energies of 455.1 eV–455.6 eV and 296.2 eV, respectively (FIG. 8). The binding energy values obtained confirm that Ti is present in the outer surface layer as TiN. High resolution spectra of processed Ti-6Al-4V specimen surfaces showed similar Ti $2p_{3/2}$ and N 1s peaks and a binding energy of 74.5 eV for Al 2p suggesting that Al maybe present as $Al_2O_3$ in the TiN outer surface layer.

EXAMPLE IV

Kinetics of Nitrogen Layer Growth

Figure 9:
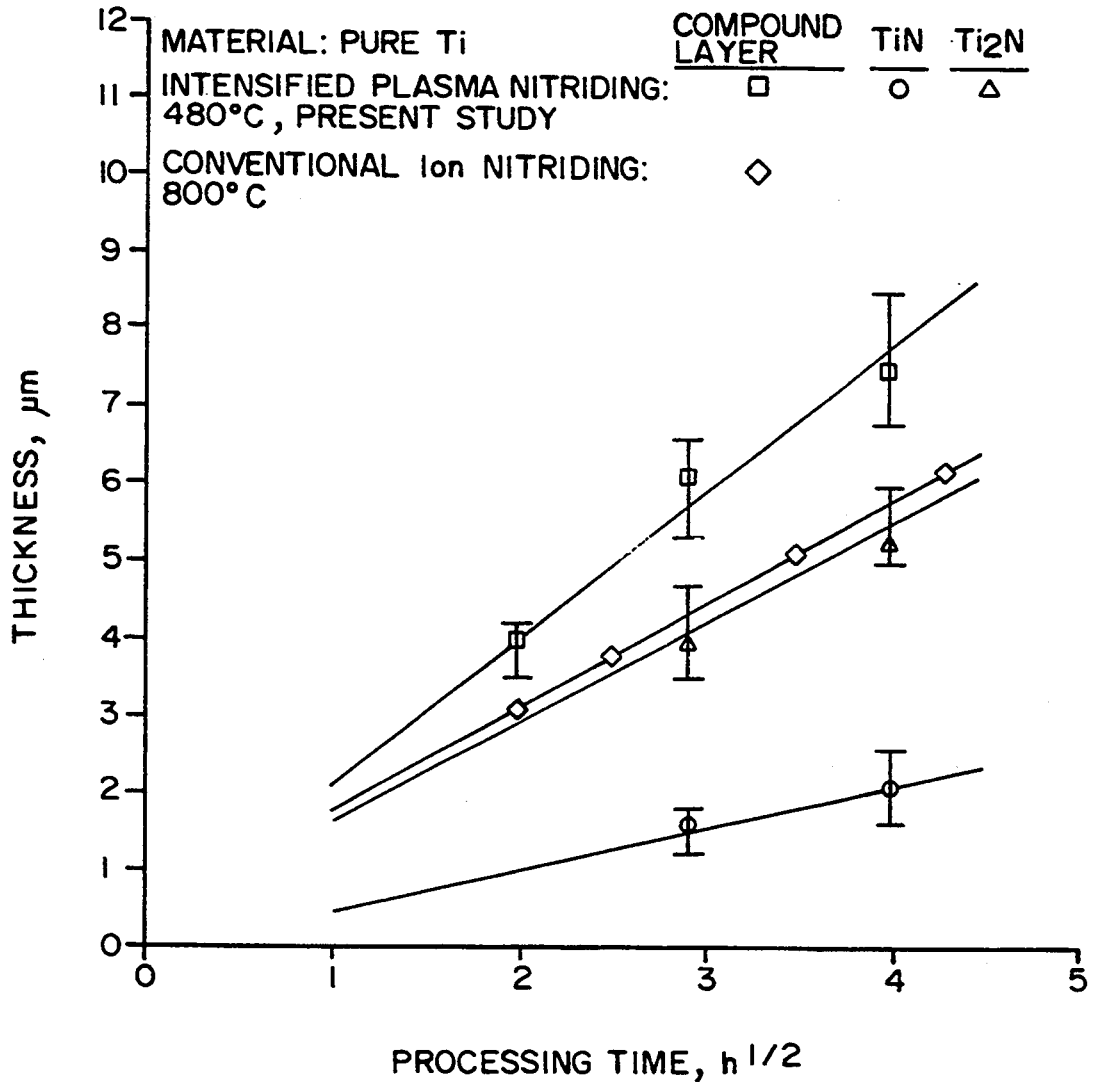
FIG. 9 illustrates the compound layer growth kinetics in pure Ti at 480° C. obtained by the present invention. The data for conventional ion nitriding at 800° C. from Metin et al., Metall. Trans., A 20 (1989) pg. 1819 is also depicted in this figure for comparative purposes.
Figure 10:
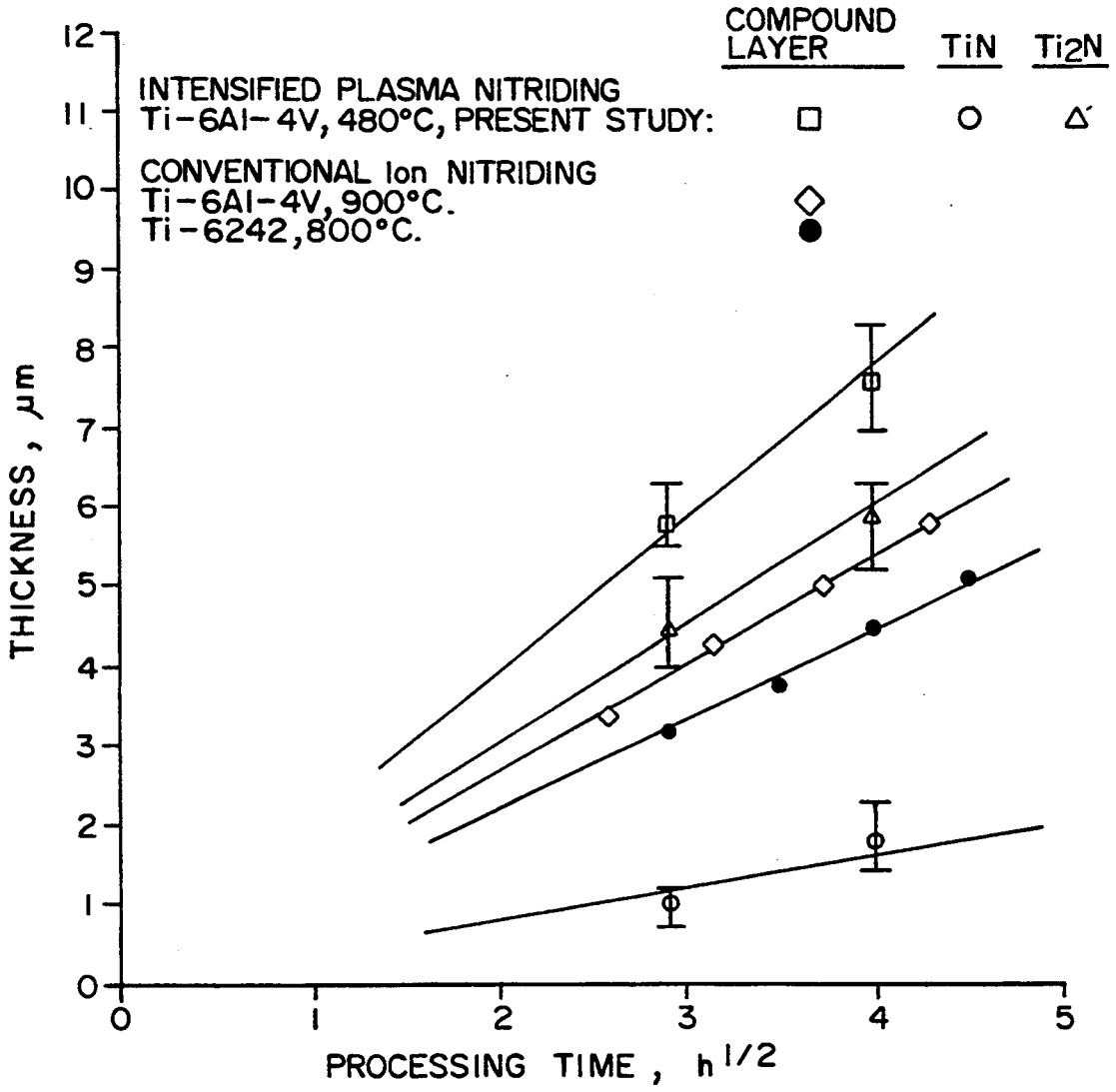
FIG. 10 illustrates the compound layer growth kinetics in Ti-6Al-4V at 480° C. obtained by the present invention. Data for conventional ion nitriding at 900° C. (see Rieet al., Mater. Sci. eng., 69 (1985), pg 473) and 800° C. (see Metin et al., in T. Spalvins (ed.), Ion nitriding, Amer. Soc. for Metals, OH, 1987, pg. 61) is also depicted for comparative purposes FIG. 11 Illustrates growth of α-case in pure Ti and Ti-6Al-4V Also, the growth of α-case in Ti at 800° C. as determined by Metin et al., in T. Spalvins (ed.), Ion nitriding, Amer. Soc for Metals, OH., 1987, pg 61 is depicted for comparative purposes.
Figure 11:
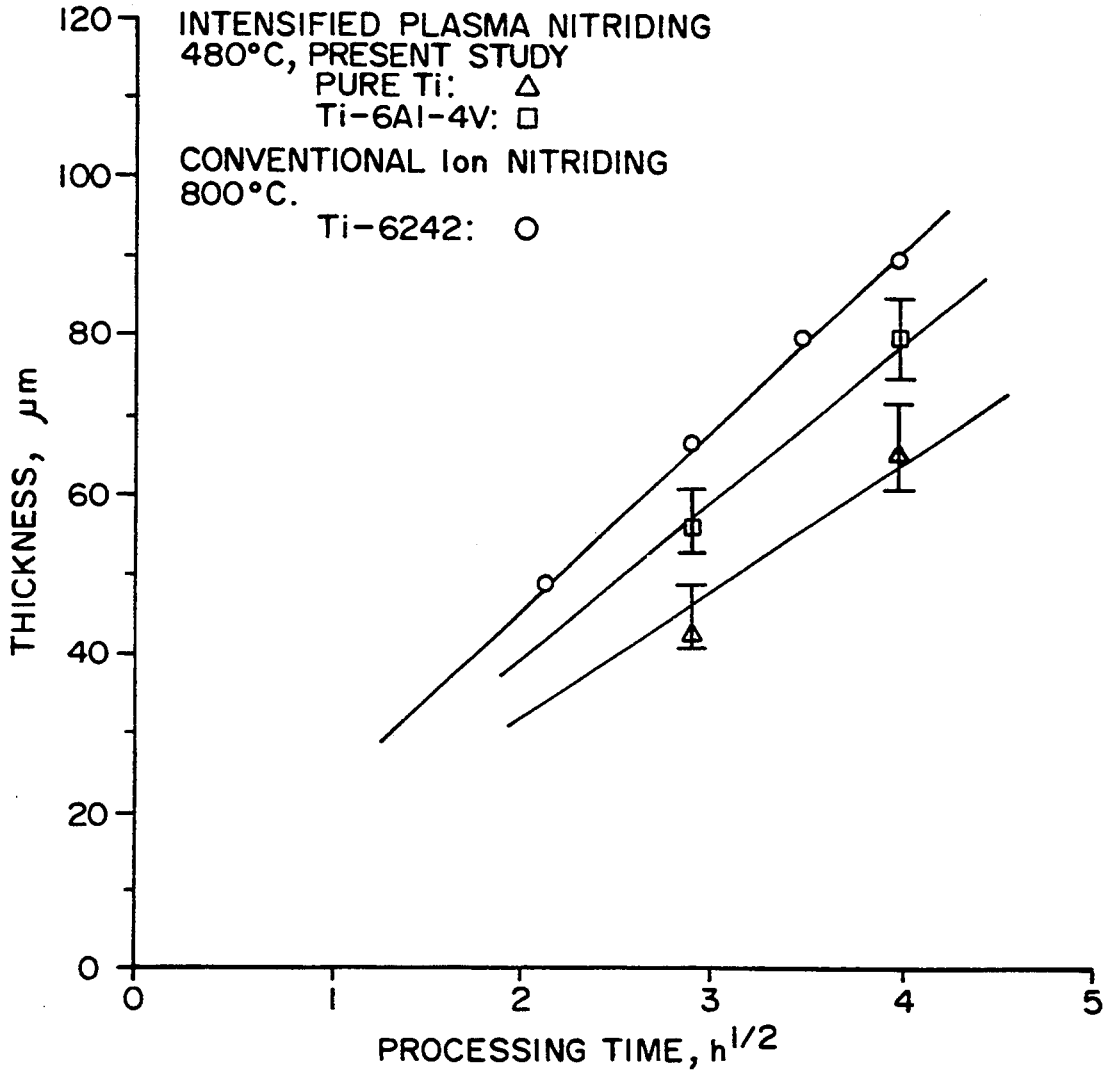

The results of the kinetic study on pure Ti and alloy Ti-6Al-4V are presented in FIGS. 9–11. The titanium and Ti-6Al-4V alloy were nitriding in accordance with Example III. FIGS. 9 and 10 show the growth kinetics of the individual TiN and $Ti_2N$ layers and the compound layer (sum of TiN and $Ti_2N$ layers) in pure Ti and Ti-6Al-4V. Both figures exhibit a linear relationship between the growth of the compound layers and the square root of time showing a volume diffusion-controlled process. It is also evident that $Ti_2N$ grows faster than TiN which exhibits very slow growth kinetics. In addition, the compound layer of Ti is always thicker than that of Ti-6Al-4V, FIGS. 9 and 10, where the opposite is true for nitrogen diffusion layer, FIG. 11. Similar observations have been made previously for conventional plasma nitriding and are consistent with the findings of Boriskina et al. Met. Sci. Heat Treat., 23 (1981), pg 503, that aluminum additions to titanium increase the nitrogen diffusion rate.

Results from previous studies utilizing conventional high pressure ion nitriding are superimposed in FIGS. 9–11 for comparison. Since the latter experiments using conventional ion nitriding process were conducted at significantly higher temperatures (800° C.), it is evident that intensification of the glow discharge causes a substantial enhancement in the compound layer growth kinetics. Based on the present layer growth data, an analytical model for multiple diffusion was used to estimate the effective N diffusion coefficient in the nitride layer. It was determined that under the present intensified glow discharge, the effective N diffusivity is at least two orders of magnitude higher than that in the conventional ion nitriding.

The enhancement of the surface bombardment by the generated highly energetic flux during ion nitriding with intensified glow discharge, is more likely responsible for the increased nitrogen diffusion. The energetic bombardment introduces vacancies and vacancy clusters along with surface heating that are expected to promote significantly the nitrogen diffusion process. The energy of particles in conventional ion nitriding, although low, is sufficient to produce a defect structure which, however, will be limited in terms of density of defects and thickness (only a few atomic layers thick). This may be due to the significantly lower particle energies prevailing during conventional ion nitriding compared to the intensified flow discharge process.

EXAMPLE V

Evaluation of Properties for Nitrided Materials

The following examples evaluate the surface roughness, wear, corrosion, and wear-corrosion properties of pure titanium or titanium-containing alloy which were nitrided by the present process in accordance with Example III.

Surface roughness measurements of specimens nitrided for 8.5 hrs indicated that processing increases the roughness parameter $R_a$ (mean arithmetic deviation from the median line of the surface profile) from 0.2 $\mu$m (as polished surface) to about 1.40 $\mu$m. This is attributed to the continuous energetic bombardment and sputtering taking place on the specimen surface during processing. It should be noted that a typical increase in surface roughness during conventional ion nitriding (low energy) is about 0.5 $\mu$m. Therefore, higher values of $R_a$ are expected when the glow discharge is intensified. This point was further demonstrated by conducting two additional tests in specimens that were processed for 4 hrs. In the first test, 3 hrs of processing was performed initially at the optimum glow discharge conditions ($i_c$=3.13 mA/cm$^2$), and then in the final 1 hr the glow discharge intensification was decreased ($i_c$=1.5 mA/cm$^2$). In the second test, the above sequence was reversed (1h at $i_c$=1.5 mA/cm$^2$ and 3 hrs at $i_c$=3.13 mA/cm$^2$). $R_a$ measurements for the above two tests indicated values of 1 $\mu$m and 0.6 $\mu$m, respectively. These results suggest that a reduced intensification initially produces a lower roughness due to the reduced sputtering. Also, TiN forms at the specimen surface during the initial stages of processing thus preventing the development of higher $R_a$ when the intensification is increased due to its low sputtering rate.

The wear results of an unprocessed and process Ti-6Al-4V specimens are shown in Table 1. The wear results present in Table 1 are from the pin-on-disc experiments described previously herein. The enhanced plasma nitriding process of the present invention results in a marked improvement in the wear performance of the Ti-6Al-4V alloy in these tests. The formation of the hard compound layer in the nitrided specimens is directly responsible for their lower wear volume loss. The significant increase in the surface hardness of the processed specimens probably causes a change in the mechanism of material removal from abrasive-adhesive wear (unprocessed) to abrasive wear. A wear mechanism that is abrasive in character causes a reduction of oxide wear debris in the sliding interface, thus improving the wear performance.

Besides hardness, the wear behavior of the nitrided specimens is expected to depend also on the surface roughness and layer thickness. Considering the fact that the processed specimens had a higher roughness, one may realize that further improvement in the wear resistance can be achieved by decreasing roughness either through surface polishing or processing initially at a lower cathode current density (lower intensification) as described previously herein. Finally, further improvement in the wear resistance of processed Ti-6Al-4V should be anticipated by determining the optimum thickness of the compound layer under the specific conditions of a particular application.

TABLE 1

Wear data from pin-on-disc experiments of unprocessed and processed Ti-6Al-4V.

| Specimen | Ball Material | | | |
|---|---|---|---|---|
| | $Al_2O_3$ | | 440 c Steel | |
| Condition | $W_a$ | $W_b$ | $W_a$ | $W_b$ |
| Unprocessed | 1.29 $mm^3$ | 0.074 $mm^3$ | 1.40 $mm^3$ | 0.033 $mm^3$ |
| Processed | 0.90 $mm^3$ | 0.018 $mm^3$ | 1.05 $mm^3$ | 0.019 $mm^3$ |
| Improvement | 30% | 76% | 25% | 42% |

Figure 12A:
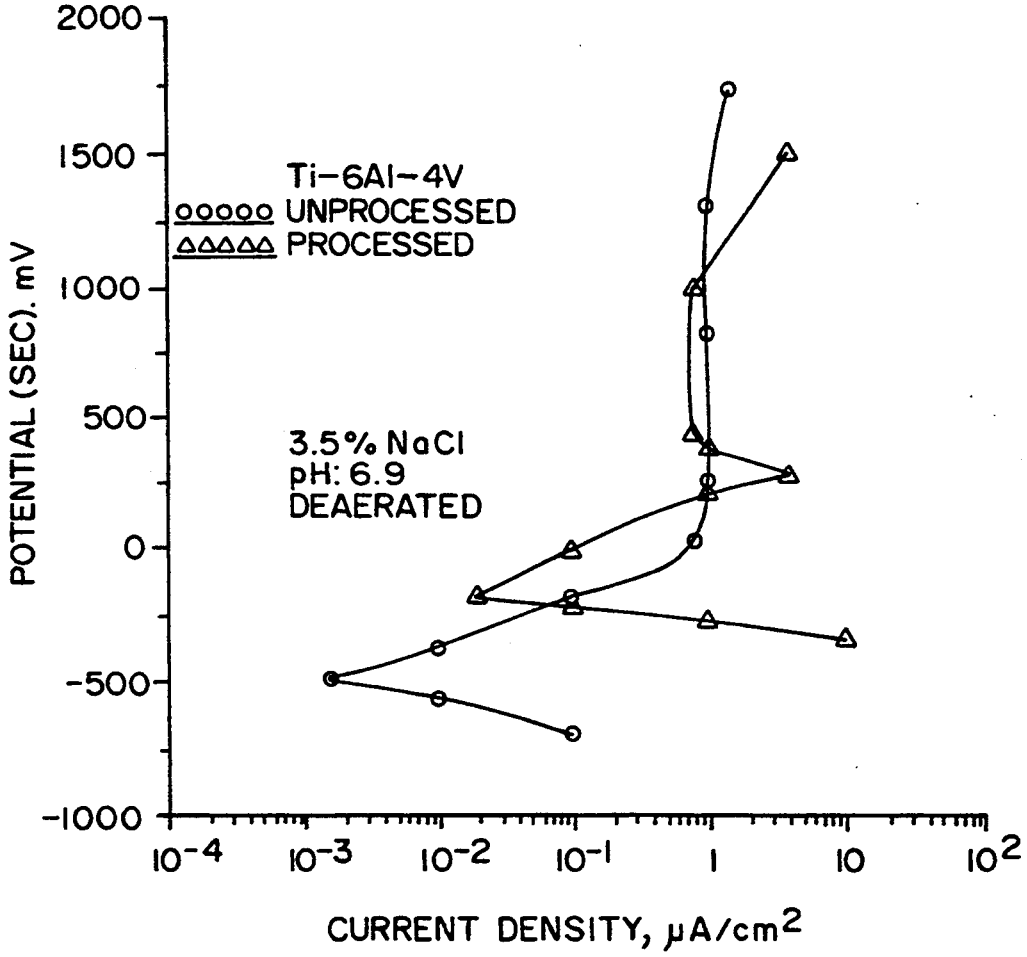
FIG. 12 shows the anodic polarization tests of processed (8.5 h) and unprocessed Ti-6Al-4V under (*a*) deaerated and (*b*) aearated conditions.
Figure 12B:
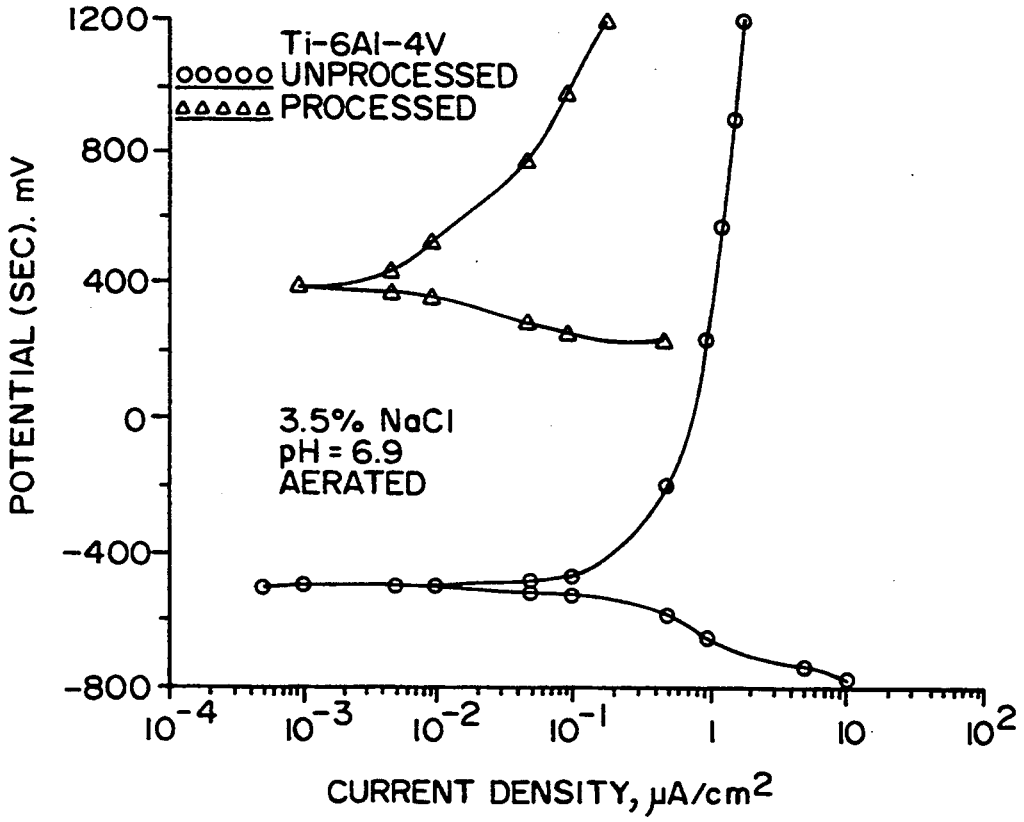

The results of the corrosion tests are illustrated by FIG. 12. FIG. 12 presents the potentiodynamic curves of anodic polarization of processed and unprocessed Ti-6Al-4V in deaerated and aerated 3.5% NaCl. Ion nitriding shifts the corrosion potential in the noble direction, promotes passivation and results in very low anodic currents. It is important to note that under aerated conditions, FIG. 12(*b*), plasma nitriding was found to decrease the corrosion rate and the passive current density by almost one order of magnitude.

The excellent corrosion resistance of Ti is mainly due to the development of highly stable $TiO_2$ which aids passivation. In the past, TiN coatings have also been found to possess exceptionally high corrosion resistance by developing a thin surface film (100A) of $TiO_2$ that forms readily and has good adherence to the TiN layer. Furthermore, it has been proposed that the nitrogen incorporated in TiN may be oxidized and may serve as an inhibitor, thus increasing the corrosion resistance.

The present results show that enhanced plasma nitriding can produce significant gains in the wear resistance without any sacrifice of the corrosion properties.

Figure 13B:
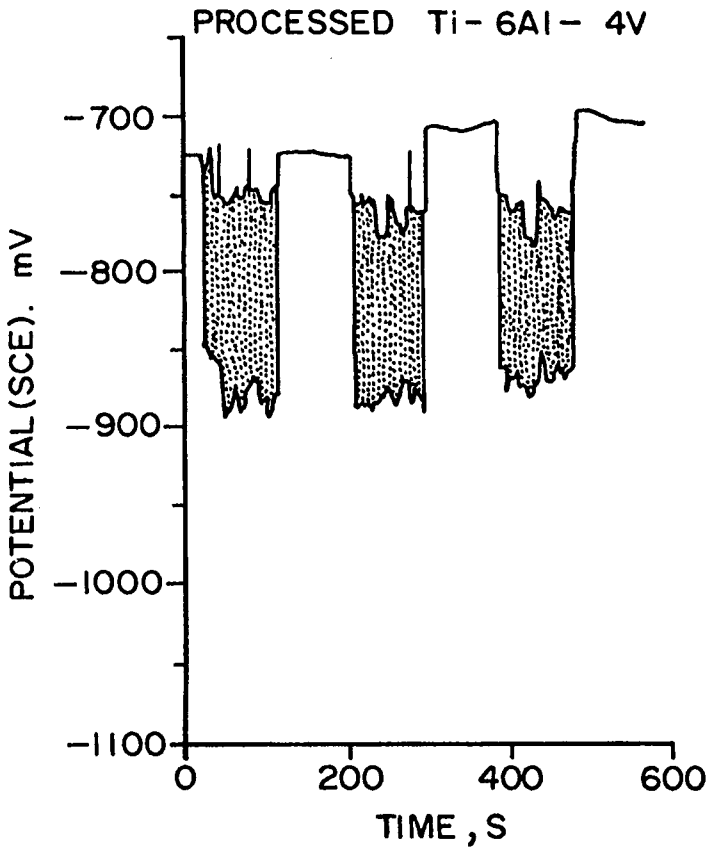
FIG. 13 shows the effect of wear on corrosion potential on processed and unprocessed Ti-6Al-4V alloys.
Figure 13A:
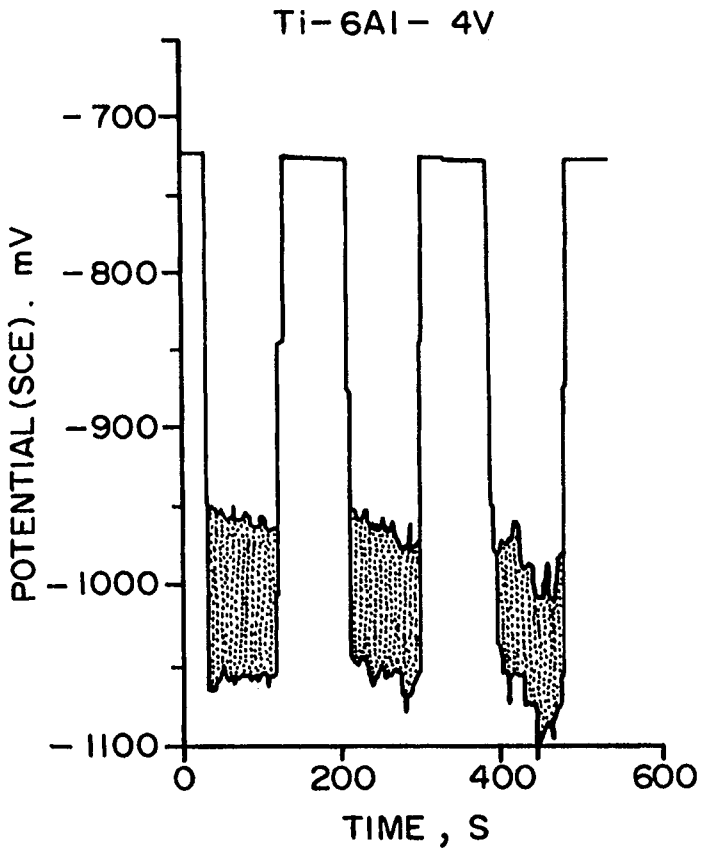
Figure 14B:
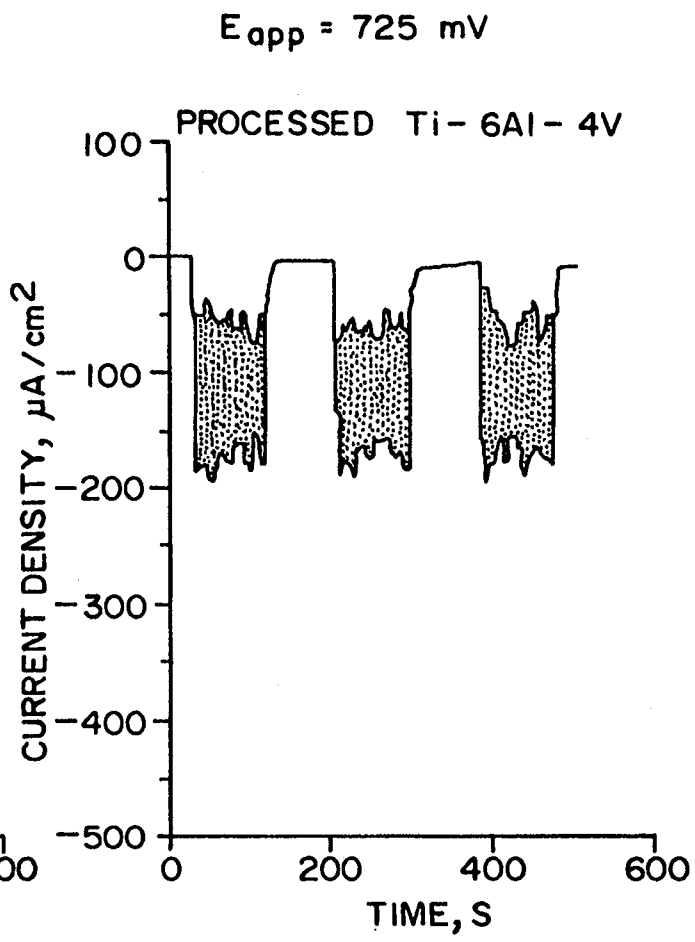
FIG. 14 shows the effect of wear on the anodic current density on processed and unprocessed Ti-6A-4V alloys.
Figure 14A:
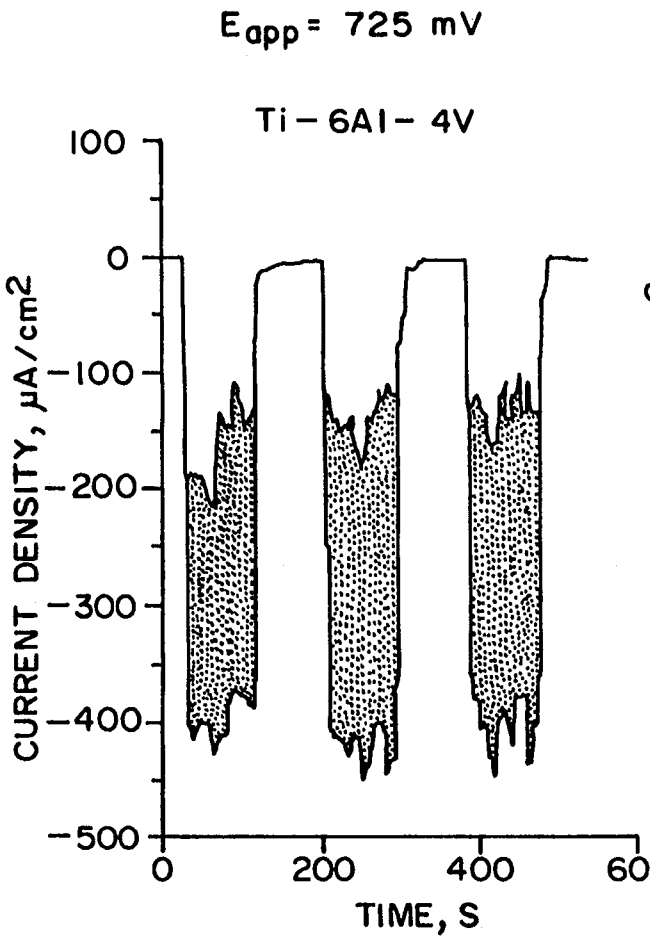

The results illustrating the effect of wear on the corrosion potential and anodic current density are presented in FIGS. 13 and 14, respectively. At the onset of the wear process, a drop in the corrosion potential is observed and the corrosion potential under wear ($E_{w-c}$) remains at low levels (active region) while the wear process is operating. When the wear action is terminated, both the processed and unprocessed specimens exhibit fast repassivation. The lowest $E_{w-c}$ values for the unprocessed and processed Ti-6Al-4V were −1120 mV and −890 mV, respectively, indicating a higher activation of the unprocessed alloy.

The $E_{w-c}$ exhibits an amplitudinal variation due to the experimentally applied wear pattern. The low $E_{w-c}$ values correspond to the freshly worn end of the specimen at the oscillation reversal point. Following that, the pin encounters areas that have been exposed in the electrolyte for increasingly longer periods of time (higher repassivation), and $E_{w-c}$ reaches a maximum at the other end of the specimen. This is followed again by a low $E_{w-c}$ when the oscillation is reversed. The average $E_{w-c}$ values for the unprocessed and processed Ti-6Al-4V were −1020 mV and −820 mV, showing again that wear caused a higher activation in the unprocessed alloy.

A similar pattern to that of $E_{w-c}$ is also exhibited by the corrosion current density under wear (FIG. 14). The average corrosion rate shown by the unprocessed and processed Ti-6Al-4V alloy under potentiostatic control was 260 $\mu A/cm^2$ and 120 $\mu A/cm^2$, respectively Thus, under wear, the processed Ti-6Al-4V shows half the corrosion rate of the unprocessed alloy. Significant reductions in the corrosion current under wear conditions have also been reported previously for TiN ion-plated coatings and for nitrogen implanted Ti-6Al-4V. It should be noted, however, that nitrogen implantation results in hardening of the near-surface region due to interstitial nitrogen or precipitation of TiN, but the modification is limited to shallow depths.

The lower corrosion rate of the processed alloy under wear can be attributed to the reduction in wear due to the high hardness of the compound layer that results in exposure of smaller surface area and better retention of the passive film. Also, in previous wear-corrosion studies of ion-plated TiN coatings, it was indicated that the rubbing action removes only a part of the passive film and therefore the corrosion rate remains at low levels. Finally, it is important to note that the processed Ti-6Al-4V showed lower mechanical wear weight losses and also, lower electrochemical material removal (the Faraday equivalent of the anodic current passed) under wear.

What is claimed is:

1. In a process for nitriding the surface of titanium or a titanium-containing alloy for providing a hard surface layer material with enhanced wear and corrosion resistance by plasma nitriding, the improvement comprising combining a thermionic emission source with a plasma nitriding glow discharge source whereby the glow discharge is intensified.

2. The process of claim 1 wherein the titanium is essentially pure.

3. The process of claim 1 wherein the titanium is alloyed with other elements, such alloys falling into categories of $\alpha$, $\beta$ and $\alpha$-$\beta$ types.

4. The process of claim 1 wherein the titanium is present in conjunction with other materials.

5. The process of claim 1 wherein the nitriding of the surface of titanium or a titanium-containing alloy is conducted at a temperature from about 300° C. to about 600° C.

6. The process of claim 1 wherein the nitriding of the surface of titanium or a titanium-containing alloy is conducted at a pressure of about 5 to about 250 mTorr.

7. The process of claim 1 wherein a surface layer of TiN followed by $Ti_2N$ layer and interstitial nitrogen diffusion layer are formed in the titanium or titanium-containing alloy.

8. The process of claim 1 wherein the glow discharge source is a positively charged electrode, a RF source or a magnetic fluid.

9. The process of claim 1 wherein the glow discharge source is operated at an applied voltage of about 1 to about 3KeV.

10. The process according to claim 1 wherein the glow discharge source had a current flux density from about 0.5 to about 4 $mA/cm^2$.

11. The process of claim 1 wherein nitriding of the surface of titanium or a titanium containing alloy occurs in a period of time from about 1 to about 20 hrs.

12. The process of claim 1 wherein the nitriding occurs under an inert gas atmosphere.

13. The process of claim 3 wherein the titanium-containing alloy is Ti-6Al-4V.

14. The process of claim 7 wherein the nitriding introduces nitrogen into the surface of titanium or a titanium-containing alloy to a depth from about 20 to about 90 $\mu$m.

15. The process according to claim 10 wherein the current flux density is 3.13 $mA/cm^2$.

16. The process of claim 12 wherein the inert gas atmosphere is selected from the group consisting of essentially pure He, Ne, Ar, $N_2$ and mixtures thereof.

17. The process of claim 14 wherein the nitriding introduces nitrogen into the surface of titanium or a titanium-containing alloy to a depth of about 50 $\mu$.

18. The process of claim 16 wherein the atmosphere is a Ar-$N_2$ mixture.

19. The process of claim 18 wherein the Ar to $N_2$ ratio is from 1:1 ranging to pure $N_2$.

20. The process of claim 19 wherein the Ar to $N_2$ ratio is 3:1.

* * * * *

UNITED STATES PATENT AND TRADEMARK OFFICE

CERTIFICATE OF CORRECTION

PATENT NO. : 5,334,264

DATED : August 2, 1994

INVENTOR(S) : Efstathios I. Meletis

It is certified that error appears in the above-indentified patent and that said Letters Patent is hereby corrected as shown below:

On the Title Page, Section [56], Column 2, line 17: "1932" should read --1832--

Column 2, line 11: "TIN" should read --TiN--

Column 2, line 12: "$\alpha$-Ti" should read --$\alpha$-Ti--

Column 3, line 41: after "compositions" insert --.--

Column 7, line 25: "Rieet" should read --Rei et--

Column 7, line 30: "Illustrates" should read --illustrates--

Column 7, line 31: after "4V" insert --.--

Column 7, line 58: "At:$N_2$" should read --Ar:$N_2$--

Column 7, line 60: "At:$N_2$32" should read --Ar:$N_2$--

Column 8, line 26: "$N_2$gas" should read --$N_2$ gas--

Column 8, line 58: after "conditions" insert --.--

UNITED STATES PATENT AND TRADEMARK OFFICE

CERTIFICATE OF CORRECTION

PATENT NO. : 5,334,264 Page 2 of 2

DATED : August 2, 1994

INVENTOR(S) : Efstathios I. Meletis

It is certified that error appears in the above-indentified patent and that said Letters Patent is hereby corrected as shown below:

Column 9, line 45: "Is" should read --ls--

Column 11, line 57: "(100A)" should read --(100Å)--

Column 12, line 27: after "respectively" insert --.--

Column 14, line 14, Claim 17: "μ" should read --μm--

Signed and Sealed this

Thirty-first Day of January, 1995

*Attest:*

*Attesting Officer*

BRUCE LEHMAN

*Commissioner of Patents and Trademarks*